United States Patent [19]

Baker, III et al.

[11] 4,185,706

[45] Jan. 29, 1980

[54] ROCK BIT WITH CAVITATING JET NOZZLES

[75] Inventors: William Baker, III, Costa Mesa; Joe W. Vincent, Balboa Island, both of Calif.

[73] Assignee: Smith Internatonal, Inc., Newport Beach, Calif.

[21] Appl. No.: 961,579

[22] Filed: Nov. 17, 1978

[51] Int. Cl.[2] ..... E21B 9/08

[52] U.S. Cl. ..... 175/340; 175/67; 239/589

[58] Field of Search ..... 175/67, 339, 340, 393; 239/589, 591

[56] References Cited

U.S. PATENT DOCUMENTS

| | | | |
|---|---|---|---|
| 2,025,261 | 12/1935 | Zublin | 175/340 X |
| 2,175,160 | 10/1939 | Zobel et al. | 239/589 |
| 2,875,984 | 3/1959 | Goodwin | 175/340 |
| 3,207,241 | 9/1965 | Neilson | 175/340 |
| 3,528,704 | 9/1970 | Johnson | 175/67 X |
| 3,713,699 | 1/1973 | Johnson | 175/67 X |
| 3,807,632 | 4/1974 | Johnson | 175/67 X |

*Primary Examiner*—Ernest R. Purser
*Attorney, Agent, or Firm*—Robert G. Upton

[57] ABSTRACT

This invention teaches the use of cavitation inducing nozzles in combination with rock bits. The cavitation nozzles enhance the drilling rate by creating catastrophic implosion waves which erode solid material at the bottom of the hole while reducing the localized pressure at the rock tooth interface. Localized pressure reduction reduces the tendency for the cuttings to adhere to the bottom of the hole due to differential pressure.

7 Claims, 10 Drawing Figures

ROCK BIT WITH CAVITATING JET NOZZLES

BACKGROUND OF THE INVENTION

1. Field of the Invention

This invention relates to the drilling art and to the means in which the drill bit is advanced in a hole.

More particularly, this invention relates to a means to enhance the drilling rate of a conventional rock bit by utilizing cavitation inducing nozzles to catastrophically erode the bottom of the hole while the bit is advanced in the hole.

2. Description of the Prior Art

The use of the cavitation phenomenon to erode solid material is taught in U.S. Pat. Nos. 3,528,704 and 3,713,699. The earlier '704 patent describes a method for utilizing the normally destructive forces of cavitation to provide an erosion effect for accomplishing drilling, boring and like functions of solids which comprise forming a fluid jet by directing the fluid through a restricted orifice at speeds sufficient to generate vapor-filled bubbles in the jet and impinging the jet against the solid at a distance from the orifice where the vapor bubbles collapse or implode.

The patent describes and illustrates fluid under pressure that is forced out of an exit opening which necks down from an upstream chamber. In most embodiments, a central concentric rod or pintle is introduced near the opening to induce cavitation as the liquid is forced out of the exit orifice. The resultant formation growth and collapse of vapor-filled cavities or "bubbles" in a flowing liquid that occurs at a level where local pressure is reduced below the vapor pressure of the liquid causes the erosion of the solid material. The implosion of the collapsing cavity happens with such violence it damages and erodes the material with which it comes into contact.

The later '699 prior art patent teaches a slight improvement in the destructive power of the cavitation phenomenon by surrounding the caviting jet with a liquid medium.

While the foregoing patents describe a means to excavate a hole, the cavitation erosion method is disadvantaged in that drilling rates are relatively slow when compared to the drilling rate of standard rock bits; such as, drag bits, one cone or multi-cone rock bits.

The instant invention combines the use of cavitation erosion principals with state of the art rock bits, resulting in unusually high drilling rates. The special cavitation nozzle enhances the drilling rate of rock bits. It was additionally determined when directing at least one of the cavitation nozzles, such as a center jet, past the cones of a two and three cone rock bit, the resultant cavitation cleans the cones, thus preventing packing or balling of the cones, thereby further improving the drilling rate of the rock bit.

SUMMARY OF THE INVENTION

It is an object of this invention to utilize a cavitating jet in combination with a rock bit.

More particularly, it is an object of this invention to use one or more cavitating jet nozzles in combination with an extended nozzle two and three cone rock bit.

A rock bit is described which normally utilizes the hydraulic action of circulating drilling mud by directing the mud through one or more nozzles aimed toward the bottom of a hole to aid the process of advancing the bit in the hole. The rock bit is improved by incorporating at least one cavitating jet nozzle body in the rock bit, the body having a first upstream opening formed by the body, smaller than a second downstream exit opening. The axis of the nozzle is substantially aligned with the axis of the bit. The body further defines a throat section positioned between the first and second opening, the throat having an opening smaller than the first upstream opening. The nozzle body when subjected to the circulating drilling mud induces cavitation of the mud as it exits past the throat section of the nozzle. The cavitation phenomenon causes erosion of material in the hole bottom which aids the cutting action of the rock bit. The divergent section is so radical (extreme) that cavitation is induced as was demonstrated in both lab and field tests.

This concept particularly teaches how to utilize cavitating jet nozzles in two and three cone rock bits. The implode waves induced by the cavitating jet nozzles and the localized pressure reduction near the bottom of the hole assist the drilling rate of the rock bits. In addition, where a cavitating jet is placed in the dome of multi-cone rock bits, the resulting cavitation serves to clean the cones of the rock bit as it is advanced in the hole.

Therefore, an advantage over the prior art is the combination of the use of the cavitation phenomenon in conjunction with single and multi-cone rock bits.

Yet another advantage over the prior art is the use of a cavitating jet nozzle in the dome of multi-cone rock bits to clean the cones as they are advanced in the hole.

Still another advantage over the prior art is the reduction of localized pressure at the rock-tooth interface, thus aiding in the removal of cuttings from the hole bottom.

The above noted objects and advantages of the present invention will be more fully understood upon a study of the following detailed description in conjunction with the detailed drawings.

FIG. 1 is a cross-section of a two cone rock bit with extended nozzles illustrating the cavitating nozzles placed in the bit dome and extended nozzles, FIG. 2 is a view looking up at the bottom of FIG. 1 illustrating the orientation of the three cavitating nozzles in the rock bit, the cones being shown in phantom line, FIG. 3 is a partial cross-section of an extended nozzle, two cone rock bit illustrating a pair of cavitating nozzles each displaced in the extended nozzle portions while a third nozzle is a standard bit nozzle in the dome of the bit, FIG. 4 is a partial cross-section of an extended nozzle two cone rock bit with a standard nozzle in one of the extended nozzle portions and a standard nozzle in the dome of the bit, the second extended nozzle having a cavitating jet nozzle disposed therein, FIG. 5 is a partial cross-section of another embodiment of a two cone rock bit with a single extended nozzle, the single nozzle having a cavitating jet nozzle disposed in the extended portion thereof, FIG. 6 is a view looking up at the bottom of the nozzle shown in FIG. 5 illustrating the orientation of the cavitating jet extending from the nozzle body, FIG. 7 is a partial cross-section of an extended jet nozzle assembly, FIG. 8 is a partial cross-section of a single cone rock bit illustrating the cavitating jet nozzle positioned therein, FIG. 9 is a partial cross-section of a drag bit with a multiplicity of cavitating jet nozzles placed in the face of the drag bit, and FIG. 10 is a view looking up at the face of the drag bit of FIG. 9 illustrating the various positions of the cavitating nozzles in the face of the drag bit.

DESCRIPTION OF THE PREFERRED EMBODIMENTS AND BEST MODE FOR CARRYING OUT THE INVENTION

Figure 1:
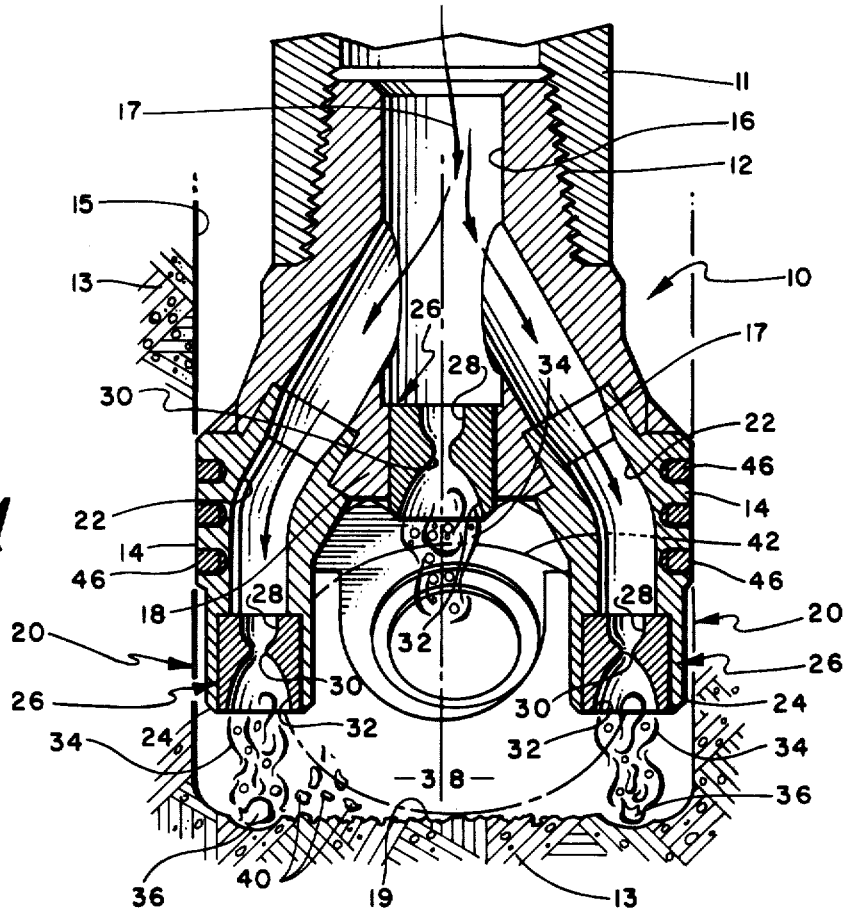
Figure 2:
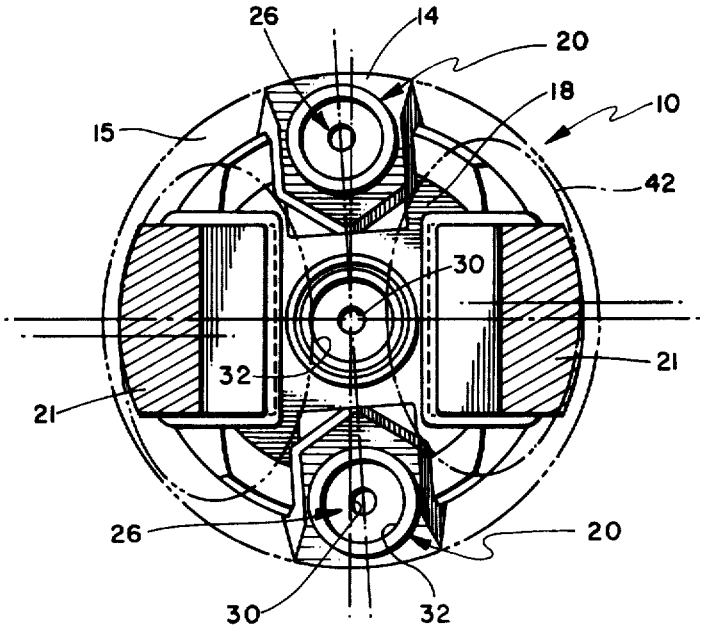

FIG. 1 illustrates a two cone rock bit, generally designated as 10. A pin segment 12 is normally threaded into a drill collar 11 which is part of a drill string (not shown). A pair of extended nozzle portions, generally designated as 20, extend down from the dome portion 18 of the rock bit 10. The cones 42 are journalled to rock bit legs 21 (FIG. 2). Four point stabilization is provided for the two cone rock bit by providing stabilizer bosses 14 on the extended nozzles 20. Tungsten carbide inserts 46 are commonly inserted in the stabilizer sections 21 to reduce wear in this area. The stabilizers 21 contacting the walls of the hole 15 stabilize the bit as the cutters 42 run on the hole bottom 19.

Unique cavitating nozzle bodies, generally designated as 26, are inserted in the base 24 of nozzles 20. Each of the cavitating nozzles 26 consist of an upstream opening 28, a narrow throat segment 30 and a larger exit opening 32. The cross-section of the nozzle depicts a converging area upstream of throat 30 and a diverging section downstream of the throat forming a chamber thereby. The opposite extended nozzle 20 has an identical cavitating nozzle 26 positioned in the base 24 of nozzle 20, each of the cavitating nozzles at the end of the extended nozzles are positioned relatively close to the hole bottom 19. An additional cavitating nozzle 26 is positioned in the dome 18 of the two cone rock bit 10.

Hydraulic mud 17 is directed down the drill string (not shown) through conduit 16 and drill bit 10. The hydraulic mud stream 17 is diverted through separate passage ways 22 in each of the extended nozzles 20. In addition, a portion of the mud is directed through the center cavitating jet nozzle 26 upstream of the cone segments 42. As the mud enters upstream opening 28 under pressure, it is accelerated through throat segments 30 and rapidly expanded towards the enlarged downstream exit opening 32 thereby inducing cavitation to the mud as it exits opening 32 of the cavitating nozzles 26.

Referring specifically to the cavitating nozzles 26 in the extended nozzles 20, as the cavitating liquid or mud exits opening 32 the expanded bubbles, as they approach the hole bottom 19, are compressed by ever increasing surrounding pressure and they catastrophically implode in area 36 adjacent the bottom of the hole 19, thereby eroding the hole bottom in the implosion area. In addition to the erosion caused by the implosion inducing cavitating jet nozzles, the localized pressure 38 at the rock tooth interface is reduced near the bottom of the hole, thereby aiding the removal of cuttings 40 from the bottom of the hole. Thus the rock bit will substantially be traversing new material in the hole bottom instead of regrinding the old cuttings.

The center cavitating jet nozzle 26 of FIG. 1 serves a different purpose. The cavitating nozzle being upstream of the rolling cones 42 serves to clean the cones as they are advanced in the hole, thus preventing balling of the cones, thereby preventing severe damage to the rock bit 10. Center jet 26 induces cavitation and the resultant agitation caused by the implosion near the surface of the cones tends to clean the cones much more thoroughly than a conventional jet nozzle. Conventional jet nozzles, on the other hand, sometimes emit a solid stream of accelerated mud through the nozzle, thus actually cutting the surface of the rolling cones as they work in the bottom of the hole. The cavitation phenomenon, since it basically is an agitating type of action, does not hydraulically cut the cones during operation of the rock bit 10.

FIG. 2 illustrates the alignment of the two extended nozzle portions with the center cavitating jet positioned in the dome 18 of the rock bit 10. Cones 42, journalled to legs 21, intermesh, one with the other, and the center jet 26 is important in that it prevents balling of the cones as heretofore described. It is readily evident that the extended nozzles 20 do not in any way interfere with the cones 42. Thus, the cavitating stream exiting the cavitation inducing jets 26 impinge directly on the bottom 19 of hole 15 (FIG. 1). The view additionally shows the stabilizing effect of the opposing bosses 14 on extended nozzles 20 that are adjacent the walls of the hole 15, while the gage row of the cones 42 is advanced in the hole bottom.

Figure 3:
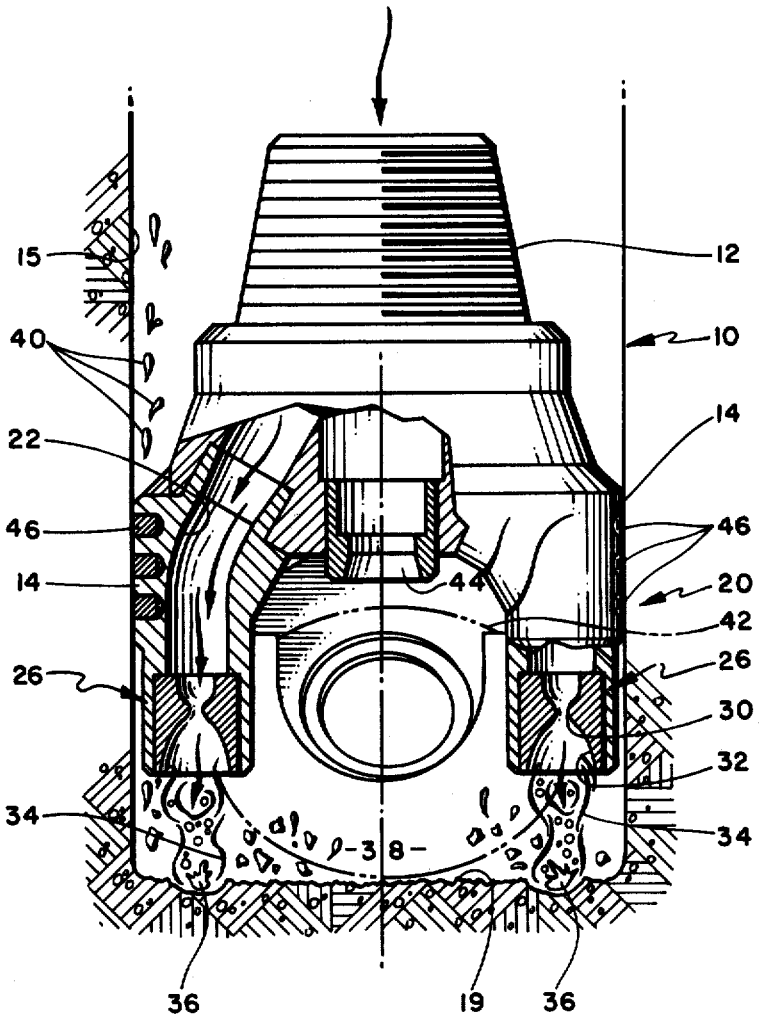

Turning now to FIG. 3, the two cone rock bit 10 is shown with two cavitating nozzles 26, one each in the nozzle extensions 20. This figure differs from FIG. 1 in that the center jet 44 is a conventional jet nozzle and directs mud from the interior of the drill string through the standard nozzle 44 to flush the cones 42.

Figure 4:
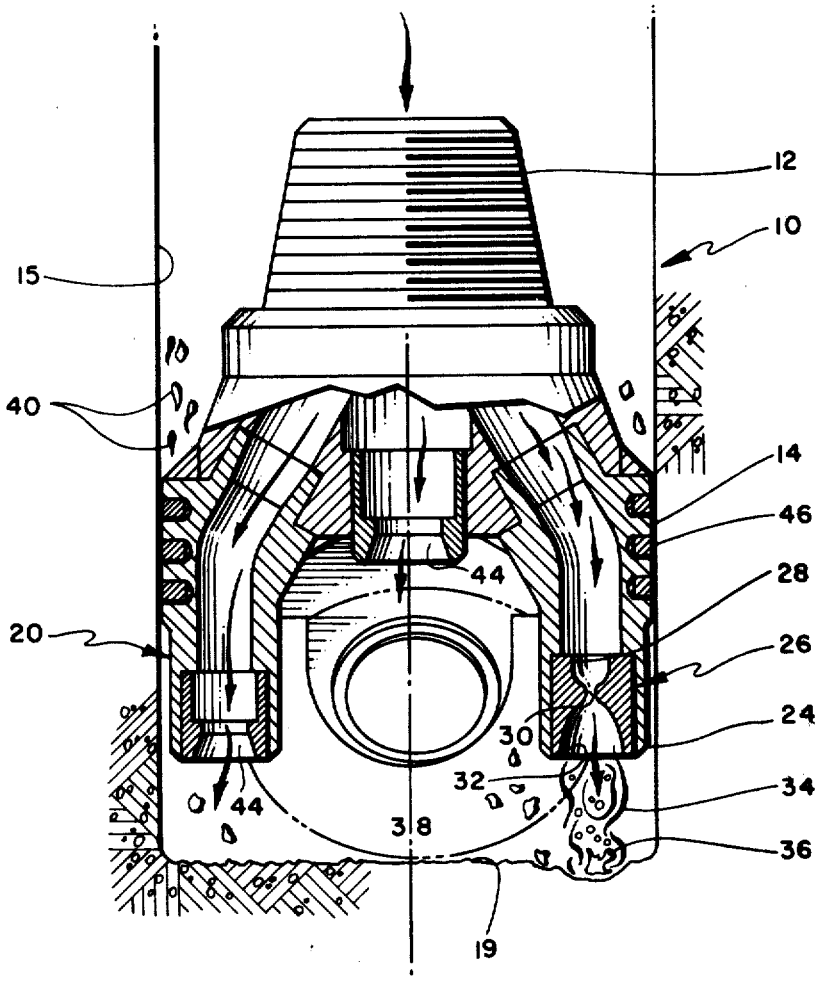

FIG. 4 differs from FIGS. 1 and 3 in that there is only one cavitation inducing jet 26 in one of the two extended nozzles 20. The other center and extended nozzle is equipped with a standard hydraulic mud nozzle.

FIGS. 1, 3 and 4 graphically illustrate the different configurations of cavitating jets in a two cone rock bit. The operator then has a choice of which combination works best in a particular rock formation.

Figure 5:
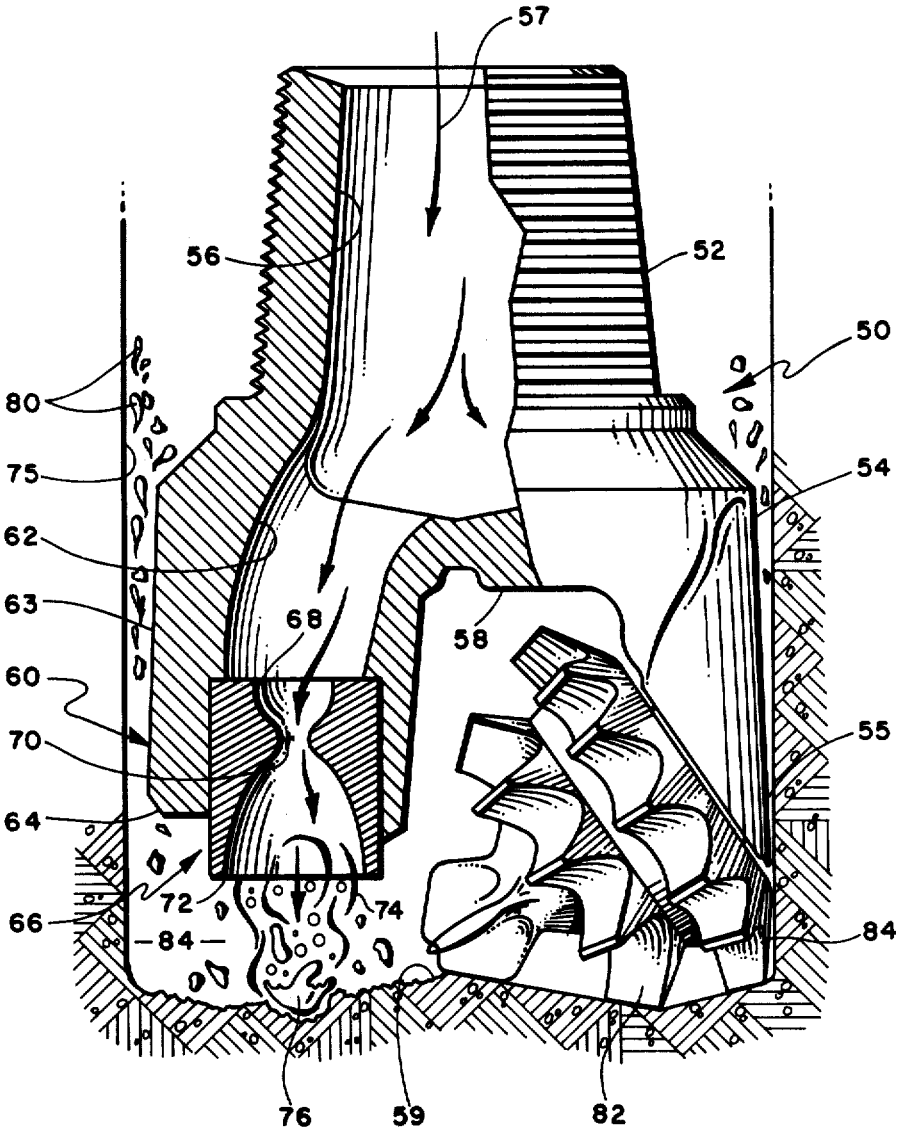

FIG. 5 illustrates a different type of two cone rock bit. The bit, generally designated as 50, consists of a pin portion 52, leg 54, shirttail 55 and milled tooth cone 82. Opposite the cones 82 is one extended nozzle, generally designated at 60. The outer surface of extended nozzle 60 forms a stabilizing boss 63 to maintain the bit 50 concentrically within the hole 75. At the base 64 of extended nozzle 60 is positioned a single cavitating jet nozzle, generally designated as 66. The jet nozzle has an upstream opening 68 which narrows down or converges to a throat portion 70 then diverges or expands out toward a larger exit opening 72 as heretofore described. As the mud is accelerated through the throat of cavitating jet 66, the mud exits into the larger cross-section with such great momentum that it cannot diffuse adequately and must cavitate. The bubbles as they advance toward the bottom 59 of hole 75 rapidly reduce in size, finally imploding adjacent the bottom 59, thus eroding the material in the bottom of the hole. The implosion again is caused by the bubble suddenly encountering a much higher pressure and the pressure causes the bubble to implode in a catastrophic manner.

Figure 6:
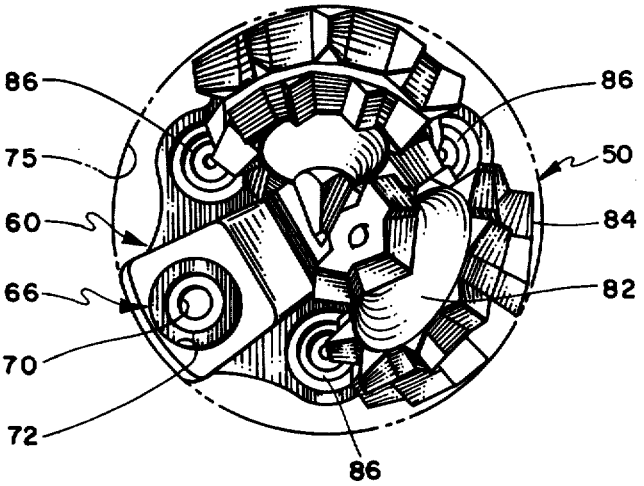
Figure 7:
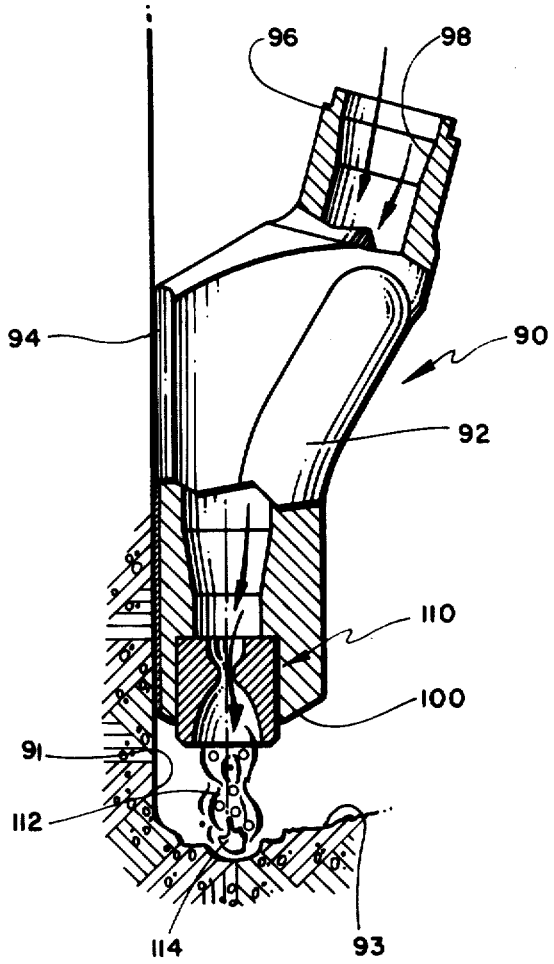

FIG. 6 illustrates the placement of standard nozzles 86 in the dome area 59 (FIG. 5). These standard jets 85 serve to clean the cones 82 as well as aid in the removal of cuttings 80 from the hole bottom 59.

The combination of the cavitation inducing jet with the multicone rock bit produces a rock bit which has an unusual drilling rate. In addition, the attendant pressure reduction facilitates more rapid flushing of cuttings in the hole bottom, further resulting in a drill bit which is highly efficient.

For example, a twelve and one-quarter inch, two cone rock bit, type A1, manufactured by the assignee of the present invention, was run in a hole where cavitation of one or more nozzles occurred. The foregoing bit corresponds to the bits illustrated in FIGS. 1 through 4. The following conditions were present during this extraordinary bit run. The hydraulic mud flow rate total was 700 gpm (gallons per minute), the hydraulic pump pressure was 3200 psi and the nozzles were as follows: the center jet (26 in dome 18 of FIG. 1) is a 10/32" jet while the two outboard jets in the extended nozzles (26 in extended nozzle body 20) were 15/32" jets. The mud weight was 10.2 ppg (pounds per gallon) and depth was between 1,447 and 5,035 feet for a total run of 3,588 feet. The drill string consisted of three 9"×3" collars, twelve 8"×3" collars and 5" drill pipe. The calculated parameters are as follows: the bit pressure drop was 2,270 psi while the cavitating nozzle flow rate was about 169 gpm. The percent of flow across the nozzle was about 24 percent while the throat velocity was calculated to be approximately 492 fps (feet per second). The A1 bit drilled virtually all of the required 12¼ inch section; 3,588 feet in forty-one and one-half hours for a drilling rate of 86 feet per hour average during the run. The foregoing 10/32" and 15/32" nozzle sizes refer to the nozzle throat opening. With reference to FIG. 1, the center cavitating nozzle 26 in the example was dimensioned as follows: the upstream nozzle entry opening 28 is 13/32 of an inch, the throat section 30 is 10/32 of an inch and the downstream exit opening 32 is 23/32 of an inch.

Figure 9:
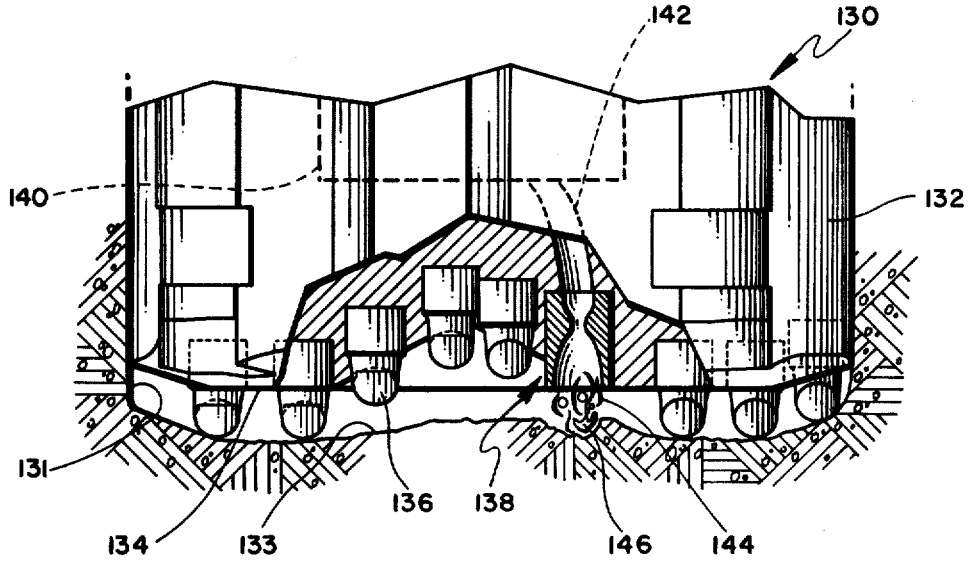

FIG. 9 illustrates an extended jet nozzle designed to be used on a soft formation three cone milled tooth rock bit (not shown). The extended jet nozzle, generally designated as 90, consists of nozzle body 92, stabilizing boss 94 on the peripheral surface of the extended nozzle. The extended nozzle body 92 positions the cavitating insert 110 close to the hole bottom 93 of drill hole 91. Thus the mud passing through conduit 98 toward the cavitating nozzle 110 is accelerated through the nozzle in a cavitating stream 112, the collapsing bubbles imploding at the hole bottom 93 at 114.

Figure 8:
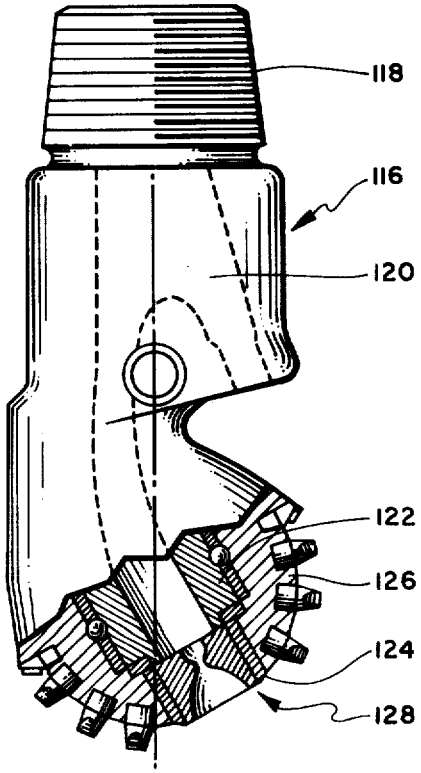

FIG. 8 is a single cone rock bit, generally designated as 116, consisting of pin 118, bit body 120, and cone 126. The cone 126 is journalled onto the bit body 120 through journal pin 122. The cavitating jet, generally designated as 128, is inserted into the pin 124 of journal pin 122.

Figure 10:
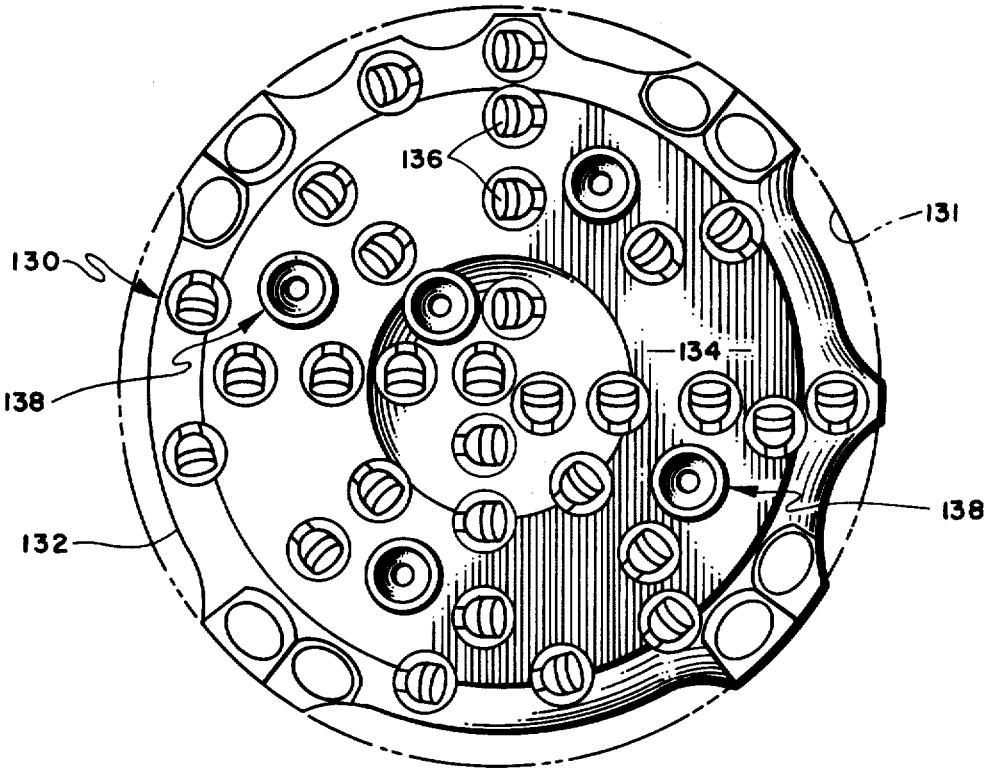

FIGS. 9 and 10 illustrate a drag bit, generally designated as 130, consisting of bit body 132, bit face 134, which has inserted therein a multiplicity of, for example, diamond faced tungsten carbide inserts. A multiplicity of cavitating jets 138 are randomly placed in the face (FIG. 10) of the bit body 132. Mud is fed through conduit 140 into diversion channels 142 and then through each of the cavitating nozzles 138. The cavitating stream 144 implodes on the surface of the hole bottom 133 of hole 131. As in the other configurations of this invention, the cavitation phenomenon lowers the pressure at the tooth interface, thereby aiding the removal of cuttings from the hole bottom.

It will of course be realized that various modifications can be made in the design and operation of the present invention without departing from the spirit thereof. Thus, while the principal preferred construction, and mode of operation of the invention have been explained and what is now considered to represent its best embodiments has been illustrated and described, it should be understood that within the scope of the appended claims the invention may be practiced otherwise than as specifically illustrated and described.

We claim:

1. In at least a two cone rock bit which utilizes the hydraulic action of circulating drilling mud by directing the mud through one or more nozzles directed toward the bottom of a hole to aid the process of advancing the bit in said hole, the improvement which comprises:

at least one cavitating jet nozzle body in said rock bit, said body having a first upstream opening formed by said body smaller than a second downstream exit opening, the axis of said nozzle being substantially aligned with the axis of said bit, said body further defining a throat section positioned between said first and second opening, said throat having an opening smaller than said first upstream opening, said throat section is closer to said upstream opening than said downstream exit opening, the diverging walls formed by said cavitating nozzle downstream of said throat forming an interior chamber thereby, said at least one nozzle body when subjected to said circulating drilling mud induces cavitation of the mud as it exits past said throat of said nozzle where said drilling mud flows through said nozzle body at a rate of about 500 feet per second.

2. The invention as set forth in claim 1 wherein said cavitating jet nozzle is positioned in at least one extended nozzle portion formed by said rock bit, the cavitating jet nozzle, being positioned near the hole bottom, induces cavitation that erodes material in said hole bottom while reducing the pressure at the rock tooth interface, the reduction of pressure aids the removal of cuttings from said hole bottom.

3. The invention as set forth in claim 2 wherein at least one cavitating jet nozzle is positioned in a dome portion formed by said rock bit, said nozzle being directed through the cones of said rock bit, the cavitation induced by said nozzle cleans said cones reducing the tendency of the cones to ball in said hole.

4. In a two cone extended nozzles rock bit, said bit comprising a pair of extended nozzle legs attached to said bit with a third center jet nozzle in the dome of said bit, wherein said rock bit utilizes the hydraulic action of circulating drilling mud by directing the mud through said nozzles toward the bottom of a hole to aid the process of advancing the bit in said hole, the improvement which comprises:

at least one cavitating jet nozzle body in said rock bit, said body having a first upstream opening formed by said body smaller than a second downstream exit opening, the axis of said nozzle being substantially aligned with the axis of said bit, said body further defining a throat section positioned between said first and second opening, said throat having an opening smaller than said first upstream opening, said throat section being positioned closer to said upstream opening than said downstream exit opening, the diverging walls formed by said nozzle downstream of said throat form a chamber thereby, said at least one nozzle body when subjected to said circulating drilling mud induces cavitation of the mud as it exits past said throat of said nozzle where said drilling mud flows through said nozzle body at a rate of about 500 feet per second.

5. The invention as set forth in claim 4 wherein said pair of extended nozzle legs contain said cavitating jet nozzles, said cavitating nozzles, being positioned near the hole bottom induce cavitation that erodes material in said hole bottom while reducing the pressure at the rock tooth interface, the reduction of pressure aids the removal of cuttings from said hole bottom.

6. The invention as set forth in claim 4 wherein said at least one cavitating jet nozzle body cavitates at a depth between about 1,000 and 6,000 feet below sea level where the hydraulic mud flow rate was about 700 gallons per minute, the mud weight was about 10 pounds per gallon, the hydraulic pump pressure was about 3,200 pounds per square inch, the rock bit pressure drop was about 2,270 pounds per square inch, the cavitating nozzle flow rate was about 170 gallons per minute and the cavitating nozzle throat flow velocity was about 500 feet per second, the upstream opening formed by said nozzle body being about 13/32 of an inch, the throat section being about 10/32 of an inch and the downstream exit opening being about 23/32 of an inch.

7. In a two cone extended nozzles rock bit, said bit comprising a pair of extended nozzle legs attached to said bit with a third center jet nozzle in the dome of said bit, wherein said rock bit utilizes the hydraulic action of circulating drilling mud by directing the mud through said nozzles toward the bottom of a hole to aid the process of advancing the bit in said hole, the improvement which comprises:

at least one cavitating jet nozzle body in said rock bit, said body having a first upstream opening formed by said body smaller than a second downstream exit opening, the axis of said nozzle being substantially aligned with the axis of said bit, said body further defining a throat section positioned between said first and second opening, said throat having an opening smaller than said first upstream opening, said throat section being positioned closer to said upstream opening than said downstream exit opening, the diverging walls formed by said nozzle downstream of said throat form a chamber thereby, said at least one cavitating jet nozzle is positioned in said dome of said two cone extended nozzle rock bit, said cavitating nozzle being directed through the cones of said bit, the cavitation induced by said nozzle cleans said cones reducing the tendency of the cones to ball in said hole.

* * * * *